United States Patent [19]

Ward et al.

[11] 3,940,656

[45] Feb. 24, 1976

[54] HIGH FREQUENCY TUBE APPARATUS

[75] Inventors: Curtis E. Ward; Maurice W. St. Clair, both of Palo Alto; James M. De Pue, Jr., Mountain View, all of Calif.; Albert J. Miller, Georgetown, Canada

[73] Assignee: Varian Associates, Palo Alto, Calif.

[22] Filed: June 13, 1957

[21] Appl. No.: 666,277

[52] U.S. Cl. ..... 315/5.18; 313/312; 316/31; 315/5.23; 333/83 T; 316/19

[51] Int. Cl.[2]. H01J 9/38; H01J 19/72; H01J 25/22; H01P 7/06

[58] Field of Search ..... 316/19, 31; 313/312; 315/5.23, 5.26, 5.37, 5.38, 18, 19, 24, 25, 5.18; 215/12; 333/83, 83 T; 331/6, 7

[56] References Cited

UNITED STATES PATENTS

| | | | |
|---|---|---|---|
| 2,070,736 | 2/1937 | Johnson | 53/221 |
| 2,219,891 | 10/1940 | Geiger | 316/19 |
| 2,220,556 | 11/1940 | Thorson | 315/5.38 X |
| 2,250,511 | 7/1941 | Varian et al. | 333/83 X |
| 2,445,811 | 7/1948 | Varian | 315/5.38 |
| 2,468,152 | 4/1949 | Woodyard | 315/5.18 |
| 2,499,977 | 3/1950 | Scott | 315/5.37 UX |
| 2,507,426 | 5/1950 | Turnry | 333/83 T |
| 2,523,031 | 9/1950 | Lafferty | 315/5.23 |
| 2,575,334 | 11/1951 | Dodd | 315/5.23 |
| 2,610,307 | 9/1952 | Hansen et al. | 333/83 X |
| 2,647,218 | 7/1953 | Sorg et al. | 316/19 UX |
| 2,750,531 | 6/1956 | Sterling | 315/5.37 |
| 2,798,982 | 7/1957 | Neher | 315/5.23 |
| 2,815,467 | 12/1957 | Gardner | 333/83 |
| 2,824,258 | 2/1958 | Snow et al. | 333/83 X |
| 2,911,602 | 11/1959 | Hayter, Jr. | 333/83 T |
| R23,277 | 10/1950 | Hansen | 315/5.38 |

FOREIGN PATENTS OR APPLICATIONS

| | | | |
|---|---|---|---|
| T10283 | 7/1956 | Germany | 315/5.19 |
| 761,260 | 11/1956 | United Kingdom | 53/221 |

*Primary Examiner*—Malcolm F. Hubler
*Attorney, Agent, or Firm*—Stanley Z. Cole; David Roy Pressman; Robert K. Stoddard

EXEMPLARY CLAIM

2. In a reflex klystron tube apparatus, means for forming a beam of electrons, a resonator means positioned along the beam path, said resonator means being apertured for the passage of the beam of electrons therethrough for electromagnetic coupling to the beam, reflector means disposed on the side of the resonator remote from said means for forming the beam of electrons, said reflector means serving for reflecting the electrons incident upon the reflecting fields of said reflector means back through said resonator means substantially along the incident beam path, said means for reflecting the electrons formed and arranged to impart a slight transverse velocity to the electrons whereby they are caused to move transversely of and out of the beam in a small number of beam transits thereby minimizing unwanted amplitude and power modulation in the output signal of the tube apparatus.

8 Claims, 4 Drawing Figures

Figure 1:
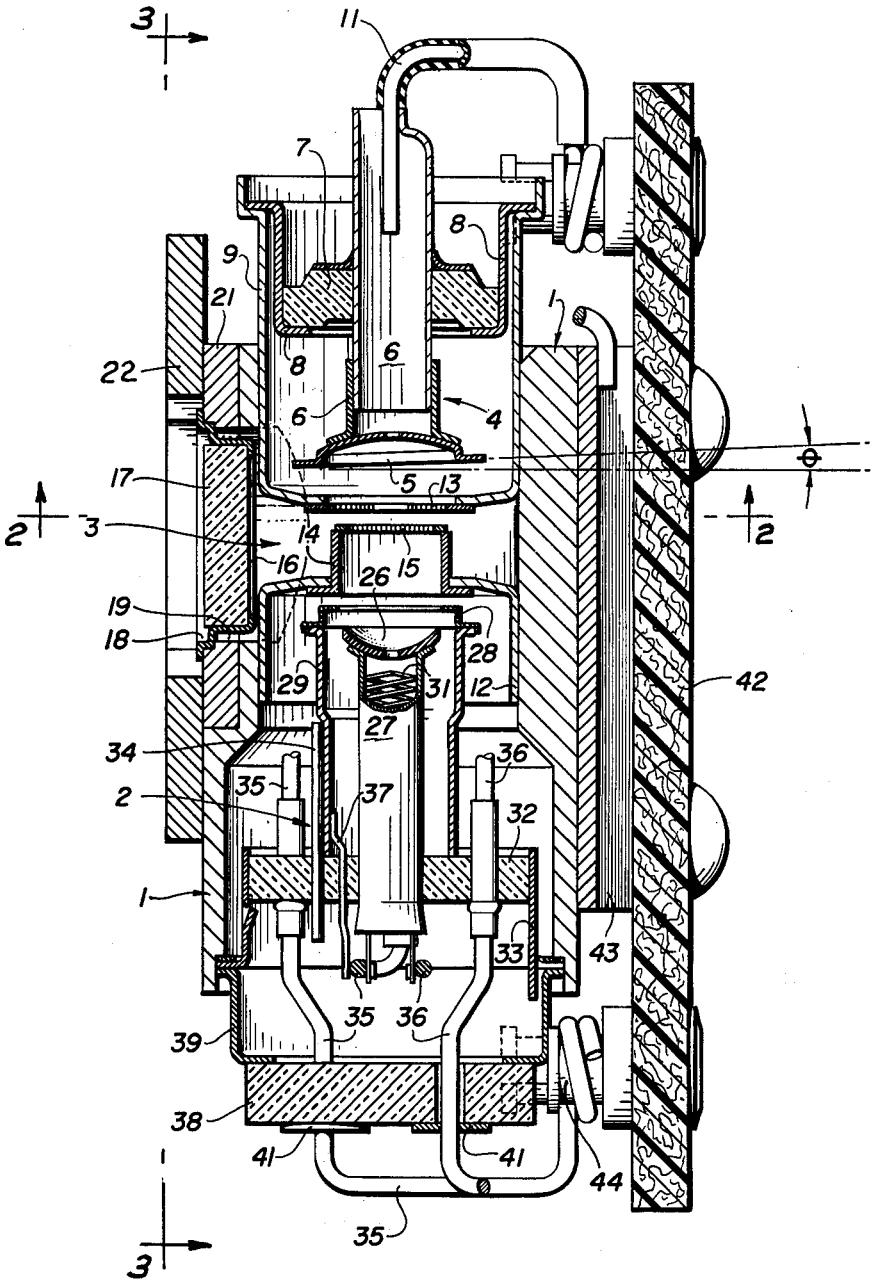

Curtis E. Ward
Maurice W. St.Clair
James M. DePue Jr.
Albert J. Miller
INVENTORS BY Paul B. Hunter
Attorney Curtis E. Ward
Maurice W. St. Clair
James M. DePue Jr
Albert J. Miller
INVENTORS BY Paul B. Hunter
Attorney

HIGH FREQUENCY TUBE APPARATUS

The present invention relates in general to a high frequency electron tube apparatus and more specifically to novel improved reflex klystron tubes useful as local oscillators, as sources of amplitude modulated and frequency modulated high frequency signals, and the like.

Heretofore reflex klystron oscillators have been plagued with several problems. One of these problems is the unwanted amplitude and frequency modulation of the output signals due to ion oscillations within the tube. Positive ions are produced within the tube by collisions of electrons with residual gas molecules within the vacuum envelope. The positive ions thus created are drawn to the center of the electron beam and under certain conditions will be trapped therewithin. While trapped the positive ions may enter into oscillations which produce unwanted amplitude and frequency modulation of the output signal. In the reflex klystron it is common for these ions to congregate and be trapped in the spaces between the two cavity resonator grids. The reason for this is that the two resonator grids are operated at a relatively high positive potential with respect to the cathode and reflector electrodes and thereby act as dams forming an ion reservoir within the beam between the two resonator grids.

Another problem encountered in klystron tubes is the lack of frequency stability in a thermally changing environment. One of the reasons for this is the fact that as the tube body increases in temperature the cavity resonator contained therewithin has a tendency to expand and furthermore to expand nonuniformly whereby undesired thermally produced changes in the resonant frequency of the cavity resonator are produced.

Another problem which has been present in the prior art reflex klystrons is the relatively complicated and cumbersome method and apparatus for coupling energy from the cavity resonator to a load via a wave permeable seal. Heretofore coupling slots serving to couple energy from a cavity resonator to a load have usually been long narrow slots cut through the side walls of the resonator and sealed over by a piece of mica thereby forming a wave permeable vacuum seal. Such coupling techniques are rather cumbersome and fragile, and therefore not readily susceptible to mass production.

Another problem is that of maintaining the vacuum integrity of the vacuum envelope of the tube apparatus, especially, at the pinched-off exhaust tubulation. The pinched-off exhaust tubulation is of soft material making it fragile and therefore susceptible to nicks and abrasions likely to destroy the vacuum seal.

Another of these problems is the undesired distortion of amplitude modulation signals caused by multiple transit electrons in the beam. Multiple transit electrons are electrons which, having been reflected from the reflector electrode back through the cavity resonator to the vicinity of the cathode, reverse direction and travel a second time through the cavity resonator and so-forth, some electrons forming into groups and making many round trips through the resonator.

The present invention provides a novel improved reflex klystron which obviates the foregoing problems.

Firstly, ion oscillations are prevented in the improved klystron oscillator by providing an enlarged aperture in the resonator grid nearest the reflector electrode whereby the large negative potential of the reflector electrode is allowed to penetrate the aperture in the resonator grid to thereby extract the positive ions tending to be trapped in the ion reservoir between the resonator grids.

Secondly, the novel klystron oscillator of the present invention is provided with a temperature compensated cavity to provide frequency stability in a changing thermal environment. This is accomplished by bowing inwardly a cavity end wall and making it out of material having a coefficient of thermal expansion which is less than that of the body of the tube whereby as the body expands the end walls of the cavity tend to be slightly separated to thereby balance out other undesired thermally produced mechanisms tending to decrease the gap spacing with increased temperature.

Thirdly, the novel reflex klystron is made more susceptible to mass production by providing a relatively large cylindrical bore intersecting with the spaces defining the cavity resonator, the bore having a circular disc-like wave permeable window transversely positioned therewithin serving to form a combined coupling iris and vacuum tight wave permeable window thereby greatly facilitating wave energy coupling and vacuum sealing of the novel reflex tube.

Fourthly, the pinched-off exhaust tubulation is provided with a thin metallic protector thereby serving to help maintain the vacuum integrity of the apparatus and protect personnel from injury on the sharp edge of the pinched-off tubulation.

Fifthly, by providing a tilted reflector for reflecting the electrons through the cavity resonator via a slightly divergent path from the incident path thereby imparting a slight transverse velocity to the electrons whereby the multi-transit electrons are caused to "walk" out of the beam after a relatively small number of beam transits.

The principal object of the present invention is to provide a novel improved tube apparatus which obviates the foregoing problems previously discussed.

One feature of the present invention is the provision of a novel resonator having an apertured resonator grid nearest the reflector electrode whereby due to the negative voltage supplied to the reflector electrode positive ions tending to be trapped in the spaces defined between the grids of the cavity resonator may be drawn to the reflector electrode and thereby prevented from entering into unwanted ion oscillation.

Another feature of the present invention is the provision of a novel improved temperature compensated cavity resonator wherein an end wall of the cavity resonator is bowed slightly inward thereof and made of a material having a coefficient of thermal expansion less than that of the side walls of the cavity resonator whereby the tendency for the gap spacing to decrease with increased temperature is offset to maintain a constant frequency in a changing thermal environment.

Another feature of the present invention is the provision of novel improved wave permeable vacuum tight output coupling method and apparatus which is of extremely simple and compact design whereby fabrication of the reflex klystrons may be greatly facilitated.

Another feature of the present invention is the provision of a novel folded metallic exhaust tubulation pinch-off protector which serves to prevent inadvertent nicks and abrasions in the fragile pinch-off likely to destroy the vacuum integrity of the evacuated tube apparatus and serving to protect personnel from the sharp edge of the pinch-off.

Another feature of the present invention is the provision of a reflector means which is adapted to produce a slight transverse velocity to the reflected electrons whereby they are caused to move transversely of the beam and out of the beam in a small number of beam transits, thereby minimizing the unwanted and deleterious effects of multiple transit electrons.

Figure 2:
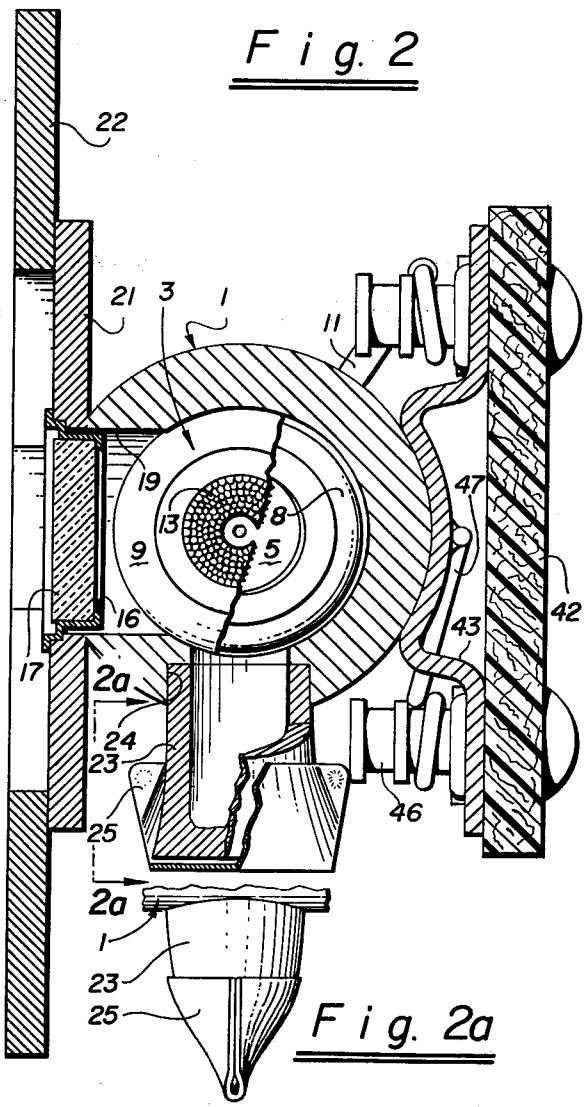
Figure 2A:
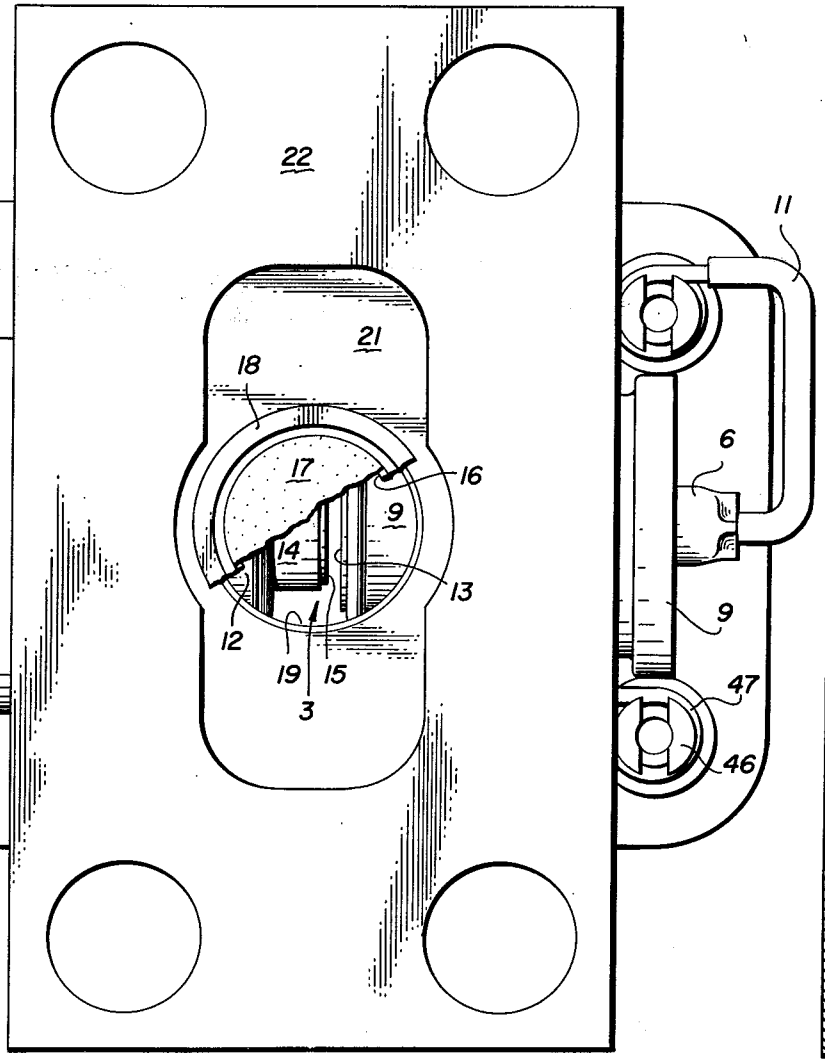
Figure 3:
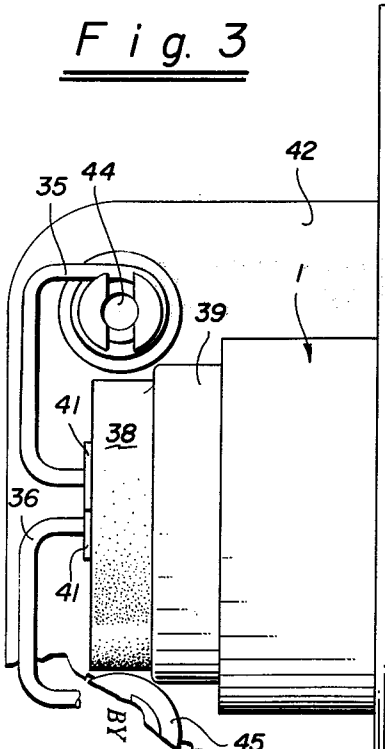

Other features and advantages of the present invention will be more apparent after a perusal of the following specification taken in connection with the accompanying drawings, wherein, FIG. 1 is a longitudinal cross-sectional view of the novel reflex klystron oscillator, FIG. 2 is a cross-sectional view of a portion of the structure of FIG. 1 taken along line 2—2 in the direction of the arrows, FIG. 2*a* is a fragmentary elevational view of a portion of the structure of FIG. 2 taken along line 2*a*—2*a* in the direction of the arrows, and FIG. 3 is an elevational view partly in section of the structure of FIG. 1 taken along line 3—3 in the direction of the arrows.

Referring now to FIGS. 1 through 3 there is shown the novel klystron oscillator of the present invention. A hollow cylindrical metallic block 1 forms the main body portion of the tube and is, in the preferred embodiment, operated at ground potential. A cathode assembly 2 is mounted in one end of the cylindrical body portion 1 insulated therefrom and serves to close off one end thereof. The cathode assembly 2 provides a beam of electrons which is directed axially of the cylindrical body portion 1. A cavity resonator 3 is centrally disposed of the main tube body 1 and is adapted to have the beam of electrons pass axially therethrough. Standing electromagnetic fields are set up within the cavity resonator 3 at the resonant frequency thereof and said fields serve to velocity modulate the beam of electrons passable therethrough.

The beam after passing through the cavity resonator 3 is directed at a reflector assembly 4 mounted in axial alignment with the beam and in one end of the tube body 1 and operated at a d.c. potential more negative than the cathode 2 and main body 1 thereby serving to reflect the beam of electrons back through the cavity resonator 3.

In the spaces between the reflector assembly 4 and the cavity resonator 3 the velocity modulation on the electron beam produces current density modulation which when passed through the resonator the second time serves to deliver power to the cavity thereby sustaining oscillations within the cavity resonator at the resonant frequency thereof.

The reflector assembly 4 comprises a dish-shaped reflecting electrode 5 centrally disposed of the tube and in axial alignment with the electron beam. The reflector electrode 5 is carried by a hollow cylindrical reflector stem 6. The stem is supported by a transversely mounted insulator 7 such as, for example, alumina ceramic, which in turn is carried via a thin metallic frame member 8 carried within a hollow metallic cup member 9. The reflector operating potential is applied to the reflector electrode 5 via an insulated lead 11.

The dish-shaped reflector electrode 5 is slightly tilted out of the plane which is normal to the beam direction by an angle $\theta$. The magnitude of the angle $\theta$ falls within a range of between 1° to 5°. The tilted reflector electrode 5 serves to reflect the electrons back via a path which is slightly divergent from the incident path thereby imparting a slight transverse velocity to the electrons whereby in a relatively few number of beam transits they are caused to "walk" transversely out of the beam. In this manner the deleterious effects of multi-transit electrons are substantially eliminated thereby greatly reducing distortion of the output signal.

The cavity resonator 3 is defined by the bottom transverse surface of the hollow cup member 9 and a similar mutually opposing hollow cup member 12. The transverse walls of the hollow cup members 9 and 12 are centrally apertured. Cup member 9 nearest the reflector electrode 5 has its central aperture therein covered over with a honeycomb reflector resonator grid 13. The other cup member 12 carries within its central aperture a flanged tubular member 14 forming the re-entrant portion of the cavity resonator 3. The flanged tubular member 14 is covered over at its free end by a honeycomb anode resonator grid 15.

The reflector resonator grid 13 is centrally apertured and, in a preferred embodiment, is made of good electrical and heat conducting material as of, for example, copper. The central aperture in the honeycombed reflector resonator grid 13 has a diameter which is greater than the diameter of several of the cellular partitions of the honeycombed grid. The enlarged opening in the reflector resonator grid allows the relatively large negative potential of the reflector electrode 5 to penetrate into the region of the cavity resonator between the resonator grids 13 and 15 to draw positive ions which are likely to congregate there to the reflector electrode 5. Removing the positive ions from the resonator spaces serves to prevent ion oscillation which produces unwanted amplitude and frequency modulation of the output signal.

Although the aperture in the reflector resonator grid has been shown and described as centrally disposed thereof this is not a requirement for operation and indeed the aperture may be disposed anywhere in the reflector resonator grid 13.

Thermal compensation of the cavity resonator 3 is necessary to produce frequency stability in a changing thermal environment. In a preferred embodiment of the present invention this is accomplished by making the main body 1 of a material having a relatively high coefficient of thermal expansion, such as, for example, steel. The thin walled metallic cup member 12, which forms one end wall of the cavity resonator 3 is made of a material having a coefficient of thermal expansion less than that of the main body 1 such as, for example, molybdenum or kovar. The transverse wall portion of the metallic cup member forming the end wall of the cavity resonator is slightly bowed inwardly of the cavity resonator 3. In addition, the flanged tubular member 14 forming the re-entrant portion of the cavity resonator 3 is made of a material having a low coefficient thermal expansion such as, for example, kovar or molybdenum. The metallic cup member 12 is secured within the bore of the main body 1 as by, for example, brazing.

When the temperature of the tube increases, the main body 1 tends to expand thereby increasing both the diameter and length of the cavity resonator 3. Moreover, the cavity resonator 3 does not have a uniform temperature distribution. More specifically, the re-entrant portion thereof defined by the flanged tubular member 14 operates at a temperature greatly above the temperature of the main body 1 because thermal energy is more readily carried away from the large tubular body 1 than from the relatively thin walled re-entrant tubular member 14. Accordingly, there are at least two mechanisms involved in changing the resonant frequency of the cavity resonator 3.

One of these mechanisms is the increase in the volume of the cavity with increased ambient temperature of the resonator 3 tending to increase its inductive reactance and therefore change its resonant frequency. The other mechanism is the tendency for decreased gap spacing with increased temperature due to the temperature differential between the re-entrant tubular member 14 and the tube body 1. This differential in temperature tends to cause the tubular member 14 to expand longitudinally proportionately more than the length of the cavity is increased thereby tending to decrease the gap spacing between the resonator grids 15 and 13 resulting in a further shift in the resonant frequency of the cavity resonator in the same direction as caused by the increased volume.

The thermal elongation of the tubular re-entrant member 14 is minimized by making the tubular member 14 of a material having a low coefficient of thermal expansion such as, for example, kovar or molybdenum.

However, additional thermal compensation is required to maintain the resonator 3 at a constant resonant frequency and this is obtained by producing an offsetting mechanism tending to increase the gap spacing between the resonator grids with increasing temperature. This is accomplished by bowing cup member 12 slightly inwardly of the cavity resonator 3 and by making it of a material having a coefficient of thermal expansion lower than that of the main body 1. In this manner as the main body expands it pulls the side walls of the cup member 12 radially outward thereby tending to straighten out the bowed cup member 12. Straightening out the cup member 12 and thus removing the bow tends to increase the gap spacing offsetting the undesired thermally produced volumetric and differential elongation effects. In this manner the resonant frequency of the cavity resonator 3 is maintained constant in a changing thermal environment.

In the preferred embodiment of the present invention it was found that sufficient temperature compensation could be provided by making cup member 12 of the material having a coefficient thermal expansion lower than that of the main body 1, while leaving the second cup member 9 of a material having substantially the same coefficient of thermal expansion as that of the main body 1. However, if it is desired to produce additional thermal compensation the second cup member 9 may be made of the same material as cup member 12 whereby as the main body 1 expands radially the slight amount of bow put into the cup member 9 is taken out and the gap spacing increased accordingly.

The cup members 9 and 12, flanged tubular member 14 and the interior of the bore within the main body 1 all forming the interior walls of the cavity resonator 3 are coated with a material having a good electrical conductivity such as, for example, silver or copper to minimize r.f. losses within the cavity resonator 3.

Although temperature compensation of the cavity resonator 3 was accomplished, in the preferred embodiment, as previously described, a similar temperature compensation may be achieved by bowing the end walls of the cavity resonator outward thereof and making the end walls of a material having a coefficient of thermal expansion larger than that of the side walls of the cavity resonator 3. When the bowing is increased with temperature the gap spacing will be adjusted to offset increased inductive reactance and compensate for proportionally greater thermal expansion of the re-entrant tubular member 14.

Electromagnetic energy at the resonant frequency of the cavity resonator 3 is coupled outwardly therefrom through an iris 16 and wave permeable vacuum window 17 as of, for example, alumina ceramic to the load. The wave permeable vacuum window 17 is mounted within a circular metallic window frame member 18 which closes off a cylindrical bore 19 intersecting the longitudinal bore in the main body 1 at substantially right angles thereto. The window frame member 18 is made of a material which does not fatigue readily such as, for example, nickel steel and is coated with a good conducting material such as, for example, copper. The window frame member 18 serves the twofold purpose of holding the dielectric wave permeable window 17 in a vacuum tight seal across the cylindrical bore 19 so that the cavity resonator may be evacuated and, in addition, forms the circular coupling iris 16 at its point of least inside diameter.

The window frame 18 is carried by a flat plate 21 mounted as by, for example, brazing on a flat portion of the cylindrical main body 1. A mounting flange 22 is carried upon the flat plate and is provided with an aperture centrally placed therein having a generally rectangular shape for matching to a section of rectangular waveguide, not shown. Four holes are provided in the corners of the mounting flange 22 for receiving screws or bolts therethrough for mounting to the rectangular waveguide.

A combined wave permeable vacuum seal and coupling iris constructed according to the teachings of the present invention provide an extremely simple method of tube construction giving a compact design and one which is readily susceptible of mass production. More specifically, the novel method of coupling to a cavity resonator comprises the steps of intersecting the cavity resonator 3 with a cylindrical bore 19 substantially at right angles thereto and then mounting across and sealing off the bore 19 with a subassembly comprising a circular dielectric window 17 contained within a circular frame 18. The smallest diameter of the window frame 18 forming the coupling iris 16 provides an extremely simple method yielding a compact design for vacuum sealing and coupling to the cavity 3 of the reflex klystron.

After the tube is assembled (see FIG. 2) it is attached to a vacuum pump, not shown, and the interior main body 1 of the klystron tube is evacuated via a soft exhaust tube 23 as of, for example, soft copper, which is mounted within a bore 24 intersecting the interior of the klystron tube. After the klystron tube has been sufficiently evacuated the soft exhaust tubulation 23 is pinched off thereby sealing off the klystron tube. A pinch-off protector 25 comprising a sheet of metal such as, for example, nickel steel is folded over the pinched-off tubulation 23 and spot welded together at the free end portions thereof to retain the pinch-off protector 25 over the pinched-off tubulation 23. The pinch-off protector 25 serves to prevent scratches or inadvertent nicks in the sharp edge of the pinched-off tubulation 23 from breaking through to the interior thereof and letting the klystron tube down to atmospheric pressure thereby rendering the klystron tube inoperative. Moreover, the pinch-off protector 25 serves to protect personnel from injury on the sharp edge of the pinched-off exhaust tubulation 23. Since the pinch-off protector 25 is made of metal it furnishes protection under adverse conditions of high ambient temperatures.

The cathode assembly 2 comprises a concave cathode emitter 26 carried upon a hollow tubular cathode support 27 in axial alignment with the bore in the main body 1 of the tube. A cathode focus ring 28 is positioned surrounding the beam of electrons which emerges from the cathode emitter 26 and in overhanging spacial relationship to the cathode emitter 26 for focusing the emitted electrons into a beam. The cathode focus ring 28 is carried upon a hollow cylindrical cathode focus support 29. A cathode heater 31 is carried within the hollow cathode emitter support 27 for heating the cathode emitter 26 to produce emission of electrons therefrom. A dielectric partition 32 transversely mounted of the cylindrical bore in the main body 1 serves to carry the cathode focus support 29 and cathode emitter support 27 therefrom. The dielectric partition 32 in turn is carried via a hollow metallic cylindrical frame 33 from the interior of the bore in the main body 1.

The cathode focus support 29 is carried from the dielectric partition 32 via three cathode focus support posts 34 positioned at 120° intervals about the circumference of the cathode focus support 29 and extending through the dielectric partition 32. Heater leads 35 and 36 extend through holes suitably provided in the dielectric partition 32 and loop back on themselves and pass through the dielectric partition 32 in the opposite direction whence they are bent for contact with the two free ends of the cathode heater element 31. The cathode focus ring 28 is operated at the same potential as the cathode emitter 26 and is electrically connected to heater lead 35 via connector 37 extending through the transversely mounted dielectric partition 32.

The open end of the hollow main body 1 is closed off at the cathode end via a transversely mounted circular dielectric cathode insulator 38 as of, for example, alumina $Al_2O_3$ which is carried from the main body 1 via a hollow cylindrical member 39. The cathode insulator 38 is provided with two openings therein for allowing the heater leads 35 and 36 to pass therethrough. The leads 35 and 36 are vacuum sealed to the dielectric cathode insulator 38 via heater lead seals 41 which are brazed to the heater leads 35 and 36 and brazed to an appropriately metalized ceramic cathode insulator 38.

The reflex oscillator tube carries a terminal board 42 via an M-shaped bracket 43 which is brazed to the main body 1 of the tube and bolted to the terminal board 42. Heater leads 35 and 36 are connected to terminals 44 and 45 respectively of the terminal board 42. Another terminal 46 is operated at ground potential and a lead 47 therefrom connects to the M-shaped bracket 43 thus connecting the main body 1 of the tube to ground potential.

Since many changes could be made in the above construction and many apparently widely different embodiments of this invention could be made without departing from the scope thereof, it is intended that all matter contained in the above description or shown in the accompanying drawings shall be interpreted as illustrative and not in a limiting sense.

What is claimed is:

1. A reflex klystron tube apparatus comprising means for forming a beam of electrons, a cavity resonator defined by enclosing side and end walls of a hollow structure disposed along the beam path for electromagnetic coupling to the beam, reflector means disposed at the end of the beam path for reflecting the electrons back for electromagnetic interaction with said cavity resonator, said reflector means formed and arranged to reflect the electrons back through said resonator via a path which is slightly divergent from the incident beam path whereby a slight transverse velocity is imparted to the returning electrons causing them to move out of the beam in a relatively small number of beam transits, a honeycomb grid forming a portion of the wall of said cavity resonator and having an enlarged opening in said grid whereby positive ions tending to be trapped on the side of said honeycomb grid remote from said reflector assembly may be drawn through said honeycomb grid to the reflector electrode and thereby prevented from entering into unwanted ion oscillations, one end wall of said cavity resonator being bowed inwardly thereof and made of a material having a lower thermal coefficient of expansion than the side walls of said cavity resonator whereby the distance between the end walls of the cavity resonator increases in variable accordance with rises in temperature thereof to lessen the capacity of said cavity to offset increased inductance to produce a constant resonant frequency of the cavity resonator in a changing thermal environment, the side wall of said cavity resonator having a cylindrical bore intersecting therewith, the bore having a circular wave permeable dielectric window member transversely positioned therewithin, a centrally apertured metallic window frame member serving to mount said wave permeable window transversely of the cylindrical bore thereby providing a combined coupling iris and vacuum tight seal, a pinched-off evacuating tube communicating with the tube apparatus and a folded metallic member affixed over said pinched-off evacuating tube of the apparatus serving to protect said fragile pinched-off tube from nicks and abrasions thus maintaining the vacuum integrity of the tube apparatus.

2. In a reflex klystron tube apparatus, means for forming a beam of electrons, a resonator means positioned along the beam path, said resonator means being apertured for the passage of the beam of electrons therethrough for electromagnetic coupling to the beam, reflector means disposed on the side of the resonator remote from said means for forming the beam of electrons, said reflector means serving for reflecting the electrons incident upon the reflecting fields of said reflector means back through said resonator means substantially along the incident beam path, said means for reflecting the electrons formed and arranged to impart a slight transverse velocity to the electrons whereby they are caused to move transversely of and out of the beam in a small number of beam transits thereby minimizing unwanted amplitude and power modulation in the output signal of the tube apparatus.

3. The apparatus according to claim 2 wherein the means to impart a slight transverse velocity to the reflected electrons comprises a dish-shaped reflector electrode, said dish-shaped electrode tilted out of a plane normal to the incident beam of electrons by an angle of between 1° and 5°.

4. In an electron tube apparatus having a cavity resonator arranged for electromagnetic coupling to a beam of electrons passable therethrough, a grid structure forming a portion of the wall of the cavity resonator, said grid structure comprising a plurality of open ended cellular elements closely spaced to each other, the openings in each cellular element being in substantial alignment with the path of the electrons forming the beam, an electrode disposed externally of the cavity resonator and for operation at a potential more negative than the potential of the cavity resonator, said grid structure of the cavity resonator having an enlarged opening therein whereby the negative potential of said electrode means may penetrate into the internal portion of the cavity resonator and serve to draw positive ions contained therewithin to said electrode.

5. The apparatus according to claim 4 wherein said electrode disposed externally of the cavity resonator for operation at a potential more negative than the potential of the cavity resonator is a reflector electrode for reflecting the electron beam back along the beam path through the cavity resonator, and said grid structure having said enlarged opening therein for drawing positive ions from within said resonator to said reflector electrode is a reflector resonator grid disposed adjacent said reflector electrode.

6. A temperature compensated cavity resonator apparatus comprising a conducting enclosure having side and end walls thereto, one end wall of the enclosure being bowed inwardly thereof, and said bowed end wall made of a material having a coefficient of thermal expansion less than the coefficient of thermal expansion of the side walls whereby as the temperature of the enclosure is increased the bowed end wall will tend to straighten out thereby tending to increase the spacing between the end walls thus offsetting the increased inductive reactance of the cavity with a decreased capacity thereby maintaining the cavity resonant frequency constant in a changing thermal environment.

7. In an electron tube apparatus, means for forming a beam of electrons, cavity resonator means having side and end walls thereto disposed along the beam path for electromagnetic coupling to the beam, a side wall of said cavity resonator means having a cylindrical bore passing therethrough and intersecting with the interior of said cavity resonator, a thin walled metallic window frame member transversely disposed of the cylindrical bore and having a circular aperture centrally disposed therein, and a wave permeable member sealed over the central aperture in said frame member whereby said frame member and said wave permeable window form a combined coupling iris and vacuum seal.

8. In an evacuated apparatus, a pinched-off exhaust tubulation, means for protecting said pinched-off tubulation comprising a thin metal member folded over on itself forming two free end portions and disposed over the pinched-off portion of the exhaust tubulation, and the free end portions of said folded member secured together to thereby hold the said folded member in position over the pinched off portion of the exhaust tubulation.

* * * * *